United States Patent [19]

Herzog

[11] Patent Number: 4,886,098

[45] Date of Patent: Dec. 12, 1989

[54] ADJUSTABLE NOZZLE SPACER

[76] Inventor: Kenneth Herzog, 135 Industrial Blvd., Riverhead, N.Y. 11901

[21] Appl. No.: 126,465

[22] Filed: Nov. 30, 1987

[51] Int. Cl.[4] ..... A65B 39/02

[52] U.S. Cl. ..... 141/368; 141/387; 141/392; 239/587

[58] Field of Search ..... 141/286, 288, 368, 387, 141/388, 312, 392; 239/587, 602, 546

[56] References Cited

U.S. PATENT DOCUMENTS

| | | | |
|---|---|---|---|
| 1,010,909 | 12/1911 | Herd | 141/368 X |
| 2,711,279 | 6/1955 | Day et al. | 141/368 X |
| 3,176,731 | 4/1965 | Minard | 141/387 X |
| 3,289,712 | 12/1966 | Smith | 141/387 X |
| 3,442,306 | 5/1969 | De Rose | 141/368 |
| 3,843,295 | 10/1974 | Greenberg et al. | 141/368 |
| 3,907,013 | 9/1975 | Harvey | 141/392 |
| 4,653,249 | 3/1987 | Simanozzi | 141/387 X |

*Primary Examiner*—Ernest G. Cusick

[57] ABSTRACT

An adjustable spacer is provided for a gravity/pressure nozzle in a machine that fills liquid into a container. The adjustable spacer will change the fill level in the container without the need of different sizes of custom made spacers since the adjustable spacer replaces the different length spacers on the gravity/pressure nozzle.

3 Claims, 1 Drawing Sheet

ADJUSTABLE NOZZLE SPACER

BACKGROUND OF THE INVENTION

The instant invention relates generally to a liquid filling machine and more specifically it relates to an adjustable spacer for a gravity/pressure nozzle in a machine that fills a product into a container.

Numerous liquid filling machines have been provided in prior art that are adapted to change the fill level of a product in containers by using different size custom made spacers on the nozzle whereby the spacers can get lost and misplaced during the operation of the liquid filling machine. While these units may be suitable for the particular purpose to which they address, they would not be as suitable for the purposes of the present invention as heretofore described.

SUMMARY OF THE INVENTION

A primary object of the present invention is to provide an adjustable spacer for a gravity/pressure nozzle in a machine that fills a product into a container that will overcome the shortcomings of the prior art devices.

Another object is to provide an adjustable spacer for a gravity/pressure nozzle in a machine that fills a product into a container that will change the fill level in the container without the need of different sizes of custom made spacers since the adjustable spacer replaces the different length spacers on the gravity/pressure nozzle.

An additional object is to provide an adjustable spacer for a gravity/pressure nozzle in a machine that fills a product into a container which will allow for faster fill level changeovers without the possibility of lost and missing spacers.

A further object is to provide an adjustable spacer for a gravity/pressure nozzle in a machine that fills a product into a container that is simple and easy to use.

A still further object is to provide an adjustable spacer for a gravity/pressure nozzle in a machine, that fills a product in a container that is economical in cost to manufacture.

A further object is to be able to "fine tune" each nozzle individually since no two nozzles are made exactly the same Further objects of the invention will appears as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

DETAILED DESCRIPTION OF THE PREFERRED EMBODIMENTS

Figure 1:
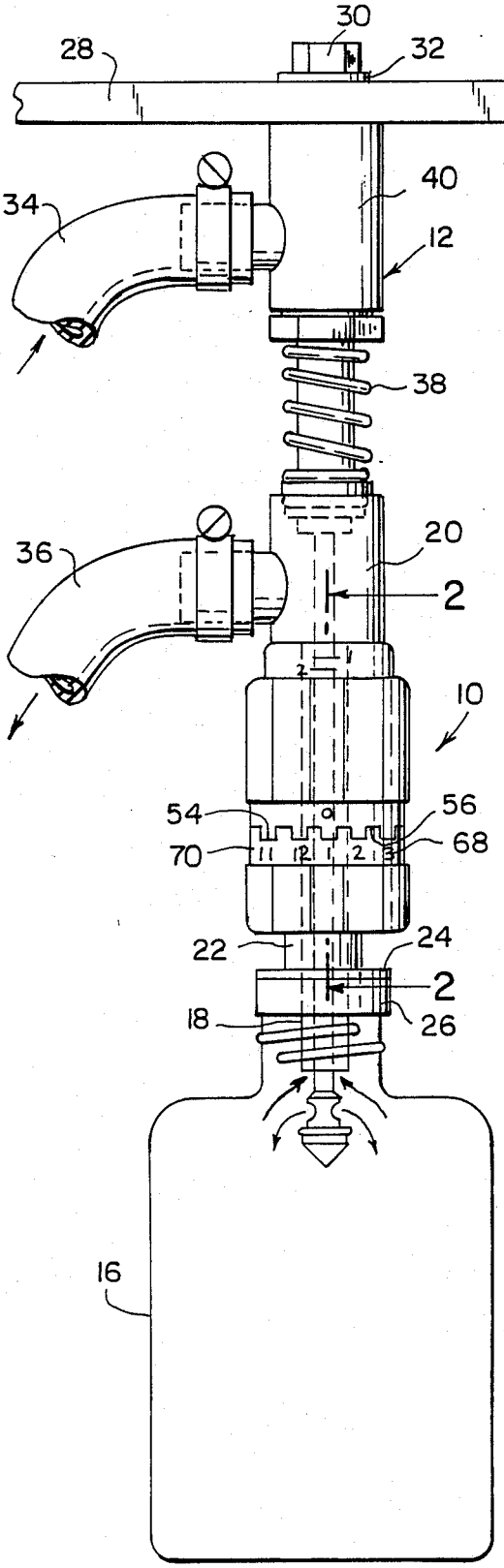
FIG. 1 is a front elevational view of the Invention installed onto a gravity/pressure nozzle in a machine that fills a product into a container with parts broken away.
Figure 2:
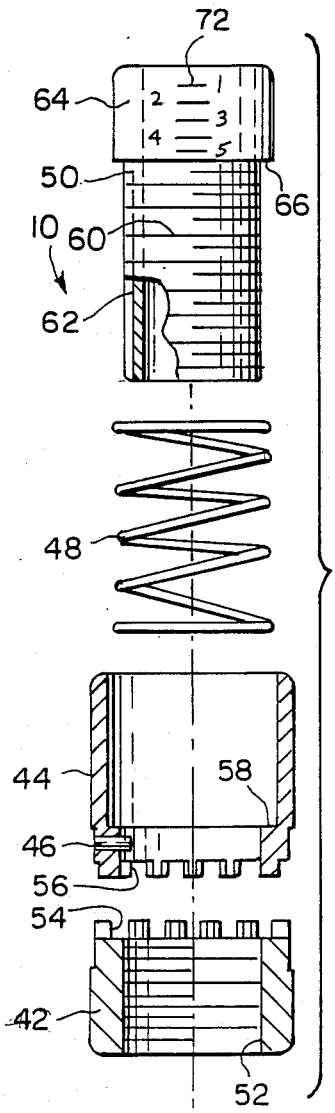
FIG. 2 is an exploded cross sectional view taken along line 2—2 in FIG. 1, showing the various parts of the adjustable spacer.

Turning now descriptively to the drawings, in which similar reference characters denote similar elements throughout the several views, FIGS. 1 and 2 illustrate an adjustable spacer 10 for a gravity/pressure nozzle 12 in a machine 14 that fills a product into a container 16. The adjustable spacer 10 mounted onto center overflow pipe 18 of the gravity/pressure nozzle 12 between lower overflow nozzle body 20 and a nozzle solid spacer 22 which rests on nozzle washer 24 and container neck seal 26. The gravity/pressure nozzle 12 is mounted on a nozzle rack front bar 28 of the machine 14 by mounting bolt 30 and washer 32. The gravity/pressure nozzle 12 also includes a nozzle supply tube 34, nozzle overflow tube 36 and a nozzle spring 38 between upper nozzle body 40 and the lower overflow nozzle body 20.

The adjustable spacer basically consists of a lower outer sleeve 42, an upper outer sleeve 44, a guide pin 46, a spring 48 and an inner sleeve 50 which is affixed to overflow pipe 18. The lower outer sleeve 42 has internal threads 52 and a plurality of first notches 54 along upper edge thereof. The upper outer sleeve 44 has a plurality of second notches 56 along lower edge thereof that mate with the first notches 54, and an inner seat 58 therein near the second notches 56. The guide pin 46 is secured to and extends transversely within the upper outer sleeve 44 between the inner seat 58 and the second notches 56. The spring 48 fits within the upper outer sleeve 44 onto the inner seat 58 thereof. The inner sleeve 50 has external threads 60 that engage with the internal threads 52 of the lower outer sleeve 42. A vertical slot 62 runs through the external threads 60 to allow the guide pin 46 in the upper outer sleeve 44 to travel up and down. A head portion 64 on the inner sleeve 50 forms an outer seat 66 thereof to engage the spring 48 and bias the upper outer sleeve 44 downward.

When the upper outer sleeve 44 is manually pulled upward the lower outer sleeve 42 can be manually rotated to move up and down on the inner sleeve 50 until the upper outer sleeve 44 is released allowing the second notches 56 to mate with the first notches 54 allowing the adjustable spacer 10 to increase and decrease its overall size between the lower overflow nozzle body 20 and the nozzle solid spacer 22 to vary the distance between the bottom of pipe 18 and the bottom of spacer 22 to change overflow condition within the container 16. As the distance between the bottom of overflow pipe 18 and the bottom of neck seal 26 varies the overflow inlet height changes whereby the container will fill to the preselected level of the overflow pipe bottom.

The lower outer sleeve includes a plurality of graduations 68 disposed on outer surface 70 below the first notches 54 to indicate each notch movement which changes the fill level by 0.005". When the lower outer sleeve 42 is turned to the left sleeve 42 moves downwardly forcing spacer 22 downwardly which moves washer 24 and neck seal 26 downwardly relative to overflow pipe 18 whereby the bottom of pipe 18 protrudes less below neck seal 26 placing the overflow pipe 18 at a higher level in the container and the fill level of the product will increase. When the lower outer sleeve 42 is turned to the right the fill level of the product will decrease because the bottom of fill pipe 18 will be lower in the bottle relative to neck seal 26 whereby overflow will start sooner reducing the height of fill.

The inner sleeve 50 includes a plurality of vertical position marks 72 on outer surface 74 of the head portion 64 to indicate vertical expansion and contraction of the adjustable spacer 10 when the lower outer sleeve 42 is turned to the left and the right.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An adjustable spacer for a gravity/pressure nozzle in a machine that fills a product into a container, said adjustable spacer fits onto a center overflow nozzle body and nozzle spacer which connects with a nozzle washer and container neck seal, said adjustable spacer comprises:

(a) a lower outer sleeve having internal threads and a plurality of first notches along an upper edge thereof;

(b) an upper outer sleeve having a plurality of second notches along a lower edge thereof that mate with the first notches and an inner seat therein near the second notches;

(c) a guide pin which is secured to and extends transversely within said upper outer sleeve between the inner seat and the second notches;

(d) a spring which fits within said upper outer sleeve onto the inner seat thereof; and (e) an inner sleeve having external threads that engage with the internal threads of said lower outer sleeve, a vertical slot which runs through the external threads to allow said guide pin in said upper outer sleeve to travel up and down and a head portion forming an outer seat thereof to engage said spring and bias said upper outer sleeve downward so that when said upper outer sleeve is manually pulled upward said lower outer sleeve can be manually rotated to move up and down on said inner sleeve until said upper outer sleeve is released allowing the second notches to mate with the first notches allowing said adjustable spacer to increase and decrease its overall size between the lower overflow nozzle body and the nozzle spacer causing downward movement of said nozzle spacer and said neck seal to change overflow condition within the container.

2. An adjustable spacer as recited in claim 1, wherein said lower outer sleeve includes a plurality of graduations disposed on an outer surface below the first notches to indicate each notch's movements which change the fill level by a specific distance, so that when said lower outer sleeve is turned to the right the fill level of the product will decrease.

3. An adjustable spacer as recited in claim 2, wherein said inner sleeve includes a plurality of vertical position marks on an outer surface of the head portion to indicate vertical expansion and contraction of said adjustable spacer when said lower outer sleeve is turned to the left and the right.

* * * * *